US005369814A

United States Patent [19]

Denys

[11] Patent Number: 5,369,814

[45] Date of Patent: Dec. 6, 1994

[54] AUTOMATIC COMMODE SEAT CLOSING SYSTEM

[76] Inventor: Joseph H. Denys, 20109 Rosedale, St. Clair Shores, Mich. 48080

[21] Appl. No.: 93,389

[22] Filed: Jul. 19, 1993

[51] Int. Cl.[5] ..... A47K 13/10

[52] U.S. Cl. ..... 4/246.2; 4/246.1; 4/248

[58] Field of Search ..... 4/246.1, 246.2, 248, 4/246.3, 246.4, 408, 249, 250

[56] References Cited

U.S. PATENT DOCUMENTS

| | | | |
|---|---|---|---|
| 1,031,876 | 7/1912 | Schossow | 4/248 |
| 1,821,027 | 9/1931 | Oya | 4/246.2 |
| 2,214,323 | 9/1940 | Carter | 4/246.2 |
| 2,849,728 | 9/1958 | Gyllenberg | 4/246.2 |
| 3,516,095 | 6/1970 | Clifton et al. | 4/246.5 |
| 4,551,866 | 11/1985 | Hibbs | 4/251 |
| 4,912,783 | 4/1990 | Shafer | 4/251 |
| 5,193,230 | 3/1993 | Guerty | 4/246.2 |
| 5,267,356 | 12/1993 | Gideon et al. | 4/248 |

FOREIGN PATENT DOCUMENTS

| | | | |
|---|---|---|---|
| 27643 | 10/1909 | Germany | 4/246.2 |
| 540794 | 10/1941 | United Kingdom | 4/246.2 |

*Primary Examiner*—Henry J. Recla
*Assistant Examiner*—Gregory M. Vidovich
*Attorney, Agent, or Firm*—Peter D. Keefe

[57] ABSTRACT

An automatic toilet seat lowering mechanism, generally composed of a water pressure sensor connected with the water supply to the toilet, a seat closure unit for effecting automatic closure of the toilet seat with a regulated rate of descent, and mechanical linkage between the water pressure sensor and the seat closure unit for automatically actuating closure of the toilet seat when the water pressure sensor detects a drop in line pressure occasioned by commencement of flushing of the toilet. The aforesaid components are easily retrofitted to an existing conventional tank-type or non-tank-type toilet with very little effort and essentially no modification. A manual over-ride in the mechanical linkage permits manual lowering of the toilet seat at any time.

22 Claims, 2 Drawing Sheets

AUTOMATIC COMMODE SEAT CLOSING SYSTEM

BACKGROUND OF THE INVENTION

1. Field of the Invention

The present invention relates to toilets, and more particularly to mechanisms for mechanically effecting lowering of the seat thereof. More particularly, the present invention relates to a toilet seat closing system which is actuated automatically when the toilet is flushed.

2. Description of the Prior Art

Commodes, more commonly and hereafter referred to as toilets, and less commonly referred to as water closets, are generally equipped with a pivotally connected seat which is positioned above the bowl. This pivotal attachment facilitates cleaning and also affords use of the toilet as a urinal by male users. Problematically, female users frequently encounter toilets immediately subsequent to a previous male user who has inadvertently failed to lower the seat after having used the toilet in its urinal mode of operation. While ordinarily this results in annoyance and inconvenience for the lady, she may be subjected to embarrassment and even potential injury if, for instance, she sleepily enters a dimly lit or unlit bathroom in the middle of the night expecting the seat to be down when in fact it is up.

In the prior art various devices have been advanced to lower the seat and/or its generally accompanying lid. In one example described in U.S. Pat. No. 4,551,866 to Hibbs, dated Nov. 21, 1985, the seat is caused to automatically return to the down position by action of a spring while the rate of descent is regulated by a piston sliding within a cylinder which thereby causes fluid flow through a check valve and a flow port, wherein the check valve permits fluid flow therethrough only when the seat is being raised. In another example, described in U.S. Pat. No. 4,912,783, to Shafer, dated Apr. 3, 1990, the lid and seat are caused to be lowered by action of a torsional coil spring acting on the lid, wherein the rate of descent is regulated by a pair of dampening cylinders (one each for the lid and the seat) which are operatively cable regulated with respect to the flush lever of the toilet.

Prior art devices suffer from complicated and expensive mechanisms which do not well mechanically interface with the toilet. What remains needed in the art is a simple, effective and inexpensive toilet seat lowering mechanism which mechanically interfaces with existing toilet technology in a truly synergistic manner.

SUMMARY OF THE INVENTION

The present invention is a simple, effective and inexpensive toilet seat lowering mechanism which mechanically interfaces with existing toilet technology in a truly synergistic manner.

The automatic toilet seat lowering mechanism according to the present invention is generally composed of a water pressure sensor connected with the water supply to the toilet, a seat closure unit for effecting automatic closure of the toilet seat with a regulated rate of descent, and mechanical linkage between the water pressure sensor and the seat closure unit for automatically actuating closure of the toilet seat when the water pressure sensor detects a drop in line pressure occasioned by flushing of the toilet. The aforesaid components are easily retrofitted to an existing conventional tank-type or non-tank-type toilet with very little effort and essentially no mortification. A manual over-ride in the mechanical linkage permits manual lowering of the toilet seat at any time.

Accordingly, it is an object of the present invention to provide mechanical closure of a toilet seat automatically upon actuation of the flush lever of the toilet.

It is another object of the present invention to provide automatic closure of a toilet seat responsive to sensing of a water pressure drop when the flush lever of the toilet is actuated.

It is a further object of the present invention to provide automatic closure of a toilet seat, wherein a spring is used only to effect pivotal movement of the toilet seat into an acute angle with respect to the toilet bowl.

It is an additional object of the present invention to provide automatic closure of a toilet seat, wherein a spring is used only to effect pivotal movement of the toilet seat into an acute angle with respect to the toilet bowl, and further wherein a one-way diaphragm piston regulates fluid flow in a cylinder to permit effortless raising of the toilet seat and regulated rate of descent of the toilet seat with a minimum of parts.

It is still another object of the present invention to provide automatic closure of a toilet seat wherein the position of the toilet seat is automatically locked, automatically unlocked when automatic closure is effected and manually unlockable when manual closure is effected.

These, and additional objects, advantages, features and benefits of the present invention will become apparent from the following specification.

DETAILED DESCRIPTION OF THE PREFERRED EMBODIMENT

Figure 1:
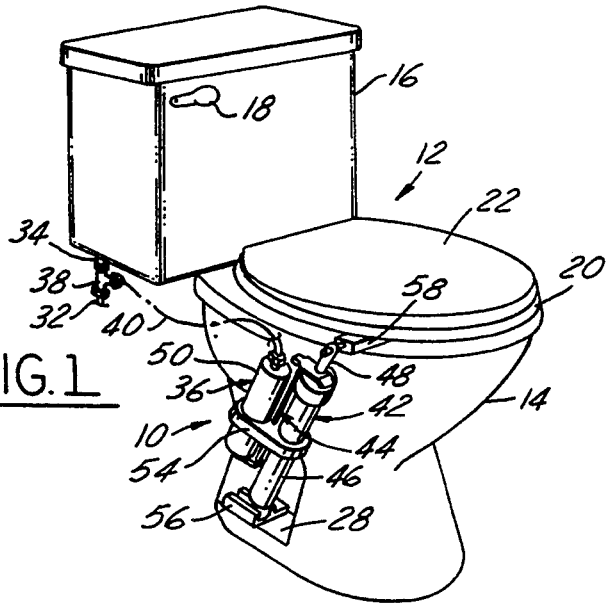
FIG. 1 is a perspective view of the automatic toilet seat lowering mechanism according to the present invention, shown in operation with respect to a tank-type toilet.

Referring now to the Drawing, FIG. 1 shows the automatic toilet seat lowering mechanism 10 according to the present invention in operation in connection with a conventional toilet 12 of the tank-type variety. A tank-type toilet is described herein by way of example because it is the most common domestic variety of toilet. It is to be understood that the automatic seat lowering mechanism 10 is connectable to and work with non-tank-type toilets equally well in the manner generally described hereinbelow.

Figure 4:
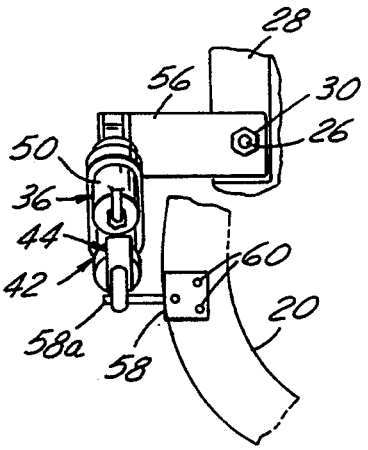
FIG. 4 is a partly broken away top plan view of the automatic toilet seat lowering mechanism according to the present invention, shown connected with the toilet seat of the toilet of FIG. 1

The toilet 12 is conventionally structured, having a bowl 14, a tank 16 for holding a reservoir of flushing water 16*a* (see FIG. 2), a flush lever 18 connected with internal plumbing of the toilet for effecting actuation of the flushing water to flushingly enter into the bowl and then subsequently into the drain, a seat 20 pivotally connected with the bowl, and (optionally) a cover 22 also pivotally connected with the bowl. The toilet 12 is secured conventionally to the floor 24 (see FIG. 2) by mounting bolts 26 passing through respective apertures of a flange 28 located on each side of the bowl 14 which are respectively fastened to the bolts by nuts 30 (see FIG. 4). A water supply pipe 32 furnishes water under pressure in a conventional manner to the tank 16 via fitting 34.

The toilet 12 is utilized in a seated mode of operation by a user pivoting the cover 22 into substantial adjacency with the tank 16, sitting upon the seat 20 with the seat in the down position whereat the seat is positioned coveringly over the bowl to do his or her business, and then flushing waste away by pressing upon the flush lever 18 to effect flushing of the toilet via emptying of the reservoir of flushing water. The toilet 12 further may be utilized in a urinal mode of operation for males by pivoting the seat 20 into the up position whereat the seat is positioned substantially perpendicular with respect to the bowl 14 and adjacent (including against) the tank 16. Problems associated with the male user not pivoting the seat down in anticipation of the next user desiring to utilize the toilet 12 in the seated mode of operation is addressed by the automatic toilet seat lowering mechanism 10 according to the present invention, as described in detail hereinbelow.

Referring now to FIGS. 1 through 4, it will be understood that the automatic toilet seat lowering mechanism 10 is composed generally of a water pressure sensor 36 connected with the water supply pipe 32 via a fitting 38 and flexible supply line 40, a seat closure unit 42 connected with the seat 20 for effecting automatic closure of the seat with a regulated predetermined rate of descent, and mechanical linkage 44 between the water pressure sensor and the seat closure unit for automatically actuating closure of the seat when the water pressure sensor detects a drop in water pressure in the flexible supply line 40 occasioned by commencement of flushing of the toilet 12.

The seat closure unit 42 is composed of a cylinder 46 having a reciprocably mounted piston shaft 48. The water pressure sensor 36 is composed of a housing 50 having a reciprocably mounted piston head shaft 52. The cylinder 46 and the housing 50 are connected together via a mounting bracket 54.

The aforesaid components are structured for being easily retrofitted to the pre-existing toilet 12 with very little effort and essentially no modification. In this regard, the following installation particulars pertain. The cylinder 46 is pivotally connected to a mounting plate 56 which is, in turn, connected to a mounting bolt 26 via a nut 30. The piston shaft 48 is pivotally connected at its distal end 48*a* to the bottom (or bowl facing) side of the seat 20 via a bracket arm 58*a* of a bracket 58 which is secured by screws 60 to the toilet seat. The fitting 38 is sealably connected to the water supply pipe 32 for example by a "T" fitting (shown) or by a pressure fitting. The flexible supply line 40 is then sealably connected with the fitting 38. As can readily be seen, the tools and mechanical acumen necessary to accomplish installation of the automatic toilet seat lowering mechanism 10 with respect to the toilet 12 is truly minimal.

Figure 5:
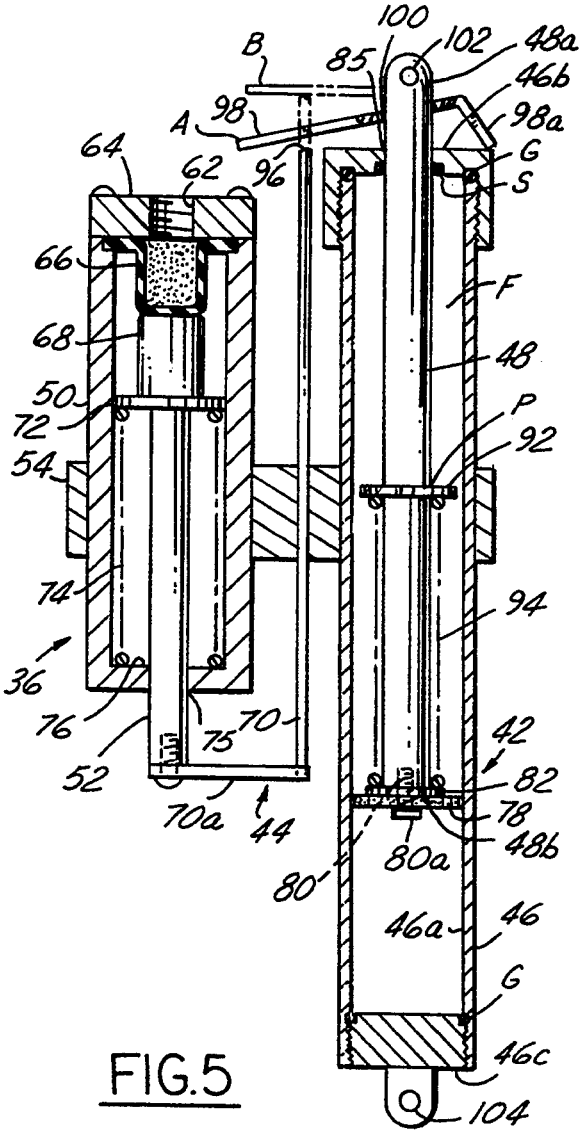
FIG. 5 is a partly sectional side view of the pressure sensor, mechanical linkage and seat closure unit of the automatic toilet seat lowering mechanism according to the present invention.
Figure 6:
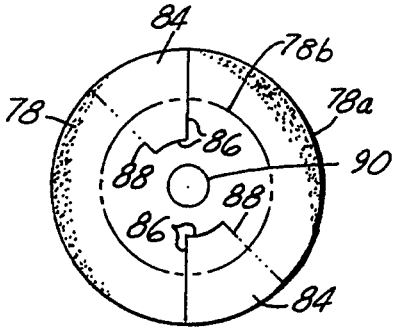
FIG. 6 is a top plan view of the diaphragm piston of the seat closure unit of the automatic toilet seat lowering mechanism according to the present invention.

The structure and function of the automatic toilet seat lowering mechanism 10 will now be further detailed with additional reference now being had to FIGS. 5 and 6.

The water pressure sensor 36 will now be detailed.

The flexible supply line 40 is sealably connected to a threaded port 62 at the head 64 of the housing 50. The threaded port 62 fluidically communicates with a resilient bladder 66 which is sealably connected with the cylinder head 64. Water pressure from the water supply pipe 32 is communicated along the flexible supply line 40 to the resilient bladder 66, thereby deformably expanding it. The piston head shaft 52 is connected at one end thereof to a piston head 68 and at the other end thereof to a connector 70*a* of a push rod 70 of the mechanical linkage 44. A piston head washer 72 abuts the piston head 68 so as to trap a spring 74 resiliently between the piston head washer and the base end 76 of the housing 50. The spring 74 biases the piston head 68 abuttingly against the resilient bladder 66. Reciprocable movement of the piston head shaft 52 is guided by the piston head washer slidably engaging the housing 50 and hole 75 in the base end 76 through which the piston head shaft extends. It is to be noted that there is no structural or functional need for the housing 50 to actually be of cylindrical shape, as shown.

The seat closure unit 42 will now be detailed.

The piston shaft 48 is connected at its proximate end 48*b* to a diaphragm piston 78 composed of a flexible membrane material, preferably a durable polymer. The diaphragm piston 78 has a perimeter 78*a* which sealably engages the inside wall 46*a* of the cylinder 46. The diaphragm piston 78 is connected to the proximate end 48*b* of the piston shaft 48 via the bolt head 80*a* of a bolt 80 which threadably engages the proximate end 48*b*. Preferably, a washer 85 is provided between the bolt head 80*a* and the piston diaphragm 78. A rigid disc 82 is provided adjacent the diaphragm piston 78 opposite the bolt head 80*a* for providing an inflexible abutment with respect to the diaphragm piston in a central portion 78*b* thereof (see FIG. 6).

As shown in FIG. 6, the diaphragm piston 78 is provided with at least one (preferably an opposed pair) of flaps 84. Each flap 84 preferably forms an "L" shape defined by two connecting cuts 86 including a radial cut extending from the periphery 78*a* to a predetermined location and a transverse cut connecting with the radial cut at said predetermined location, wherein flexing of each flap occurs, respectively, along a radially disposed flex line 88 that extends from the transverse cut to the periphery. The radially disposed flex line 88 provides flappable movement for the flaps 84, respectively, as will be understood more completely from the operational description hereinbelow. A central aperture 90 is provided in the diaphragm piston for receiving therethrough the bolt 80.

A thrust washer 92 is trapped on the piston shaft 48. A seat bias spring 94 is situated between the thrust washer 92 and the rigid disc 82. The length of the seat bias spring 94 determines a predetermined neutral resting position P for the thrust washer 92 with respect to the piston shaft 48, the nature of which become clear from the operational description hereinbelow. The cylinder is filled with a fluid F, preferably (but not necessarily) a hydraulic fluid. In order to seal the cylinder from leakage of the fluid F, gaskets G are provided at the top and bottom end caps **46*b*, 46*c* thereof, and a seal S is provided for abutting the piston shaft 48 at the piston hole 85 in the top end cap through which the piston shaft extends. A hole at the distal end 48*a* of the piston shaft 48 provides for pivotal connection to the bracket arm 58*a*. A mounting plate connector 104 provides pivotal connection of the cylinder 46** with the mounting plate via a pivot pin.

The mechanical linkage will now be detailed.

The push rod 70 extends between, and parallel with, the cylinder 46 and housing 50, and terminates at a thrust surface 96. A locking lever 98 is provided adjacent the top end cap **46*b* of the cylinder 46. In this regard, the locking lever 98 is provided with a shaft aperture 100 through which the piston shaft 48 slides. The locking lever 98 is provided with a bent end portion 98*a*, the orientation of which is toward the cylinder 46. The shaft aperture 100 is dimensioned with respect to the piston shaft 48 such that when the locking lever 98 is in the locked position A, frictional binding between the shaft aperture and the piston shaft occurs which freezes the piston shaft relative to the locking lever. This is accomplished by an acute angle of the locking lever with respect to the top end cap 46*b* being assumed as a result of the bent end portion 98*a* forceably abutting the top end cap 46*b*. In the unlocked position B wherein the locking lever is substantially parallel with respect to the top end cap 46*b*, the piston shaft 48 freely slides with respect to the shaft aperture 100 without frictional binding. A user can grasp the end of the locking lever 98 opposite the bent end portion 98*a* to manually over-ride the aforesaid frictional binding by moving the locking lever 98** into the unlocked position B.

Figure 7:
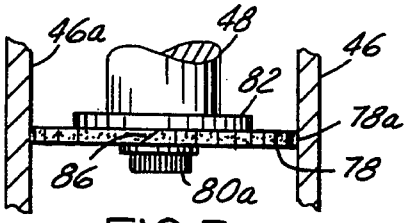
FIG. 7 is a partly sectional side view of the cylinder and diaphragm piston of the automatic toilet seat lowering mechanism according to the present invention, shown while the toilet seat is unmoving.
Figure 8:
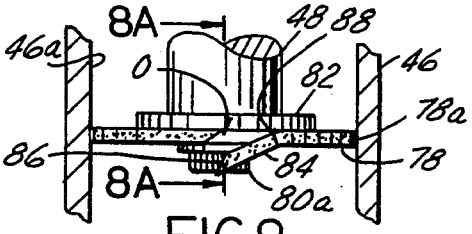
FIG. 8 is a partly sectional side view of the cylinder and diaphragm piston of the automatic toilet seat lowering mechanism according to the present invention, shown while the toilet seat is being raised.
Figure 9:
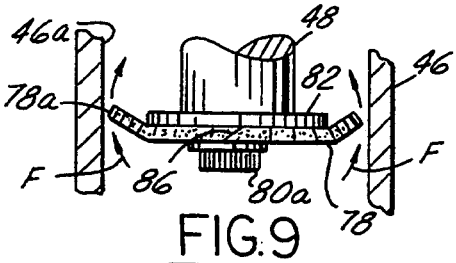
FIG. 9 is a partly sectional side view of the cylinder and diaphragm piston of the automatic toilet seat lowering mechanism according to the present invention, shown while the toilet seat is descending.

Operation of the automatic toilet seat lowering mechanism 10 will now be detailed with reference being additionally had to FIGS. 7 through 9.

Figure 2:
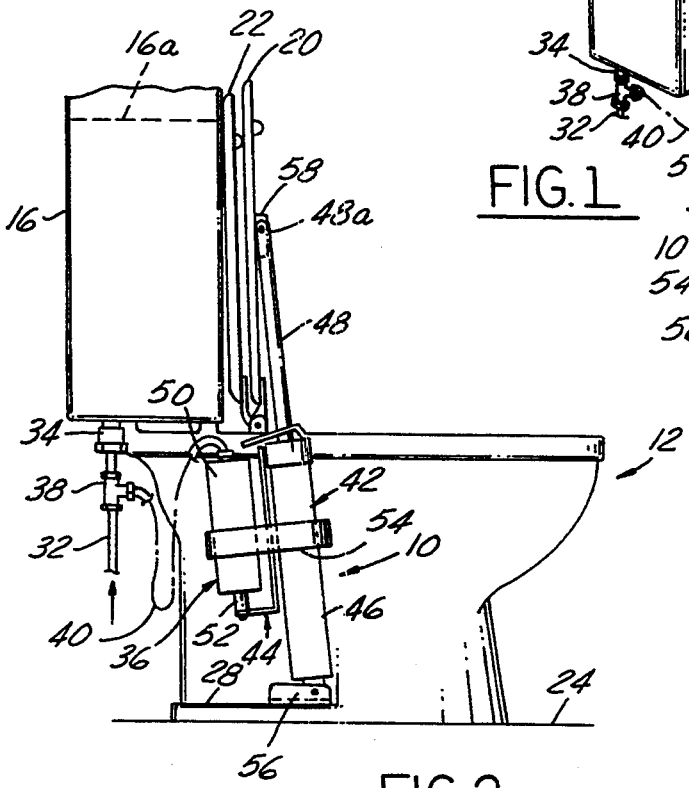
FIG. 2 is a side view of the automatic toilet seat lowering mechanism according to the present invention, shown in operation with the toilet of FIG. 1, wherein the toilet seat is in the up position.

Starting with the toilet 12 in the operational configuration shown in FIG. 1, a male user wishes to use the toilet in its urinal mode of operation. The male user pivotably raises the cover 22 and the seat 20. While raising the seat 20, the piston shaft 48 slide with respect to the cylinder 46, since the cylinder is pivotally connected to the mounting plate and the piston shaft is pivotally connected with the seat. When the seat 20 is fully pivotally raised, as shown in FIG. 2, the cylinder 46 and housing 50 have pivoted relative to the mounting plate and the seat, as shown by comparison with FIGS. 1 and 2. The flexible supply line 40 is amply long and flexible to accommodate this movement.

Figure 8A:
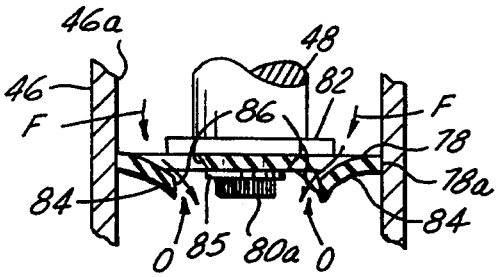
FIG. 8A is a partly sectional view along arrow 8A of FIG. 8, showing the flaps of the diaphragm piston of the automatic toilet seat lowering mechanism according to the present invention in operation while the seat of the toilet seat is being raised.

While the piston shaft 48 slides with respect to the cylinder 46, the locking lever 98 does not frictionally hind with respect to the shaft aperture 100 since the bent end portion **98*a* is not forceably abutting the top end cap 46*b*. Further, while the piston shaft slides, the piston diaphragm 78 is subjected to fluid pressure as the fluid in the cylinder between the diaphragm piston and the top end cap 46*b* seeks to displace into the space between the diaphragm piston and the bottom end cap 46*c*. This fluid pressure causes the flaps 84 to flex at the respective flex lines 88 to thereby result in openings O at the cuts 86 (see FIGS. 8 and 8A). Accordingly, fluid F flows at a substantially unimpeded flow rate through the openings O resulting in relatively little resistance being occasioned by the travel of the diaphragm piston toward the top end cap 46*b***.

During pivoting, the seat 20 reaches the apex position of its travel with respect to the bowl 14, wherein the seat is vertically oriented. Thereafter, the seat pivots a little more toward the tank 16 so that the seat and cover naturally stay, under gravitational urging, restably against the tank. Before the apex position is reached by the seat, the neutral resting position P of the thrust washer 92 is selected so that the thrust washer 92 abuts the top end cap **46*b* and as the seat continues pivoting, the seat bias spring 94 is compressed. This compression is at least sufficient to carry the seat from its resting position adjacent the tank to an acute angle with respect to the bowl beyond the apex position. However, when the seat is let go by the user, the locking lever 98 prevents the seat bias spring 94 from effecting pivotal movement of the seat, as a result of the aforementioned frictional binding which now occurs at the shaft aperture 100 with respect to the piston shaft 48. This occurs due to the locking lever moving into the locked position A as the bent end portion 98a forceably abuts the top end cap 46*b*** as a result of gravity pulling on the portion of the locking lever opposite the bent portion from the shaft aperture.

Figure 3:
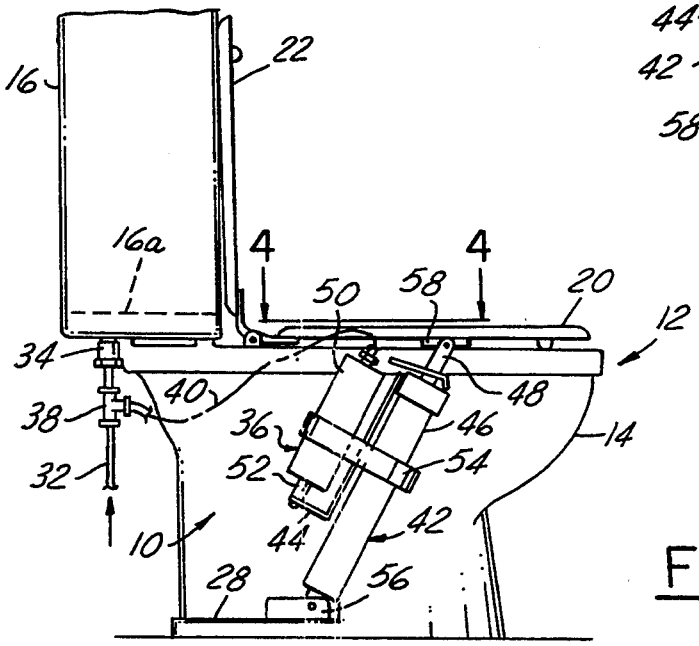
FIG. 3 is a side view of the automatic toilet seat lowering mechanism according to the present invention, shown in operation with the toilet of FIG. 1, wherein the toilet seat is in the down position.

Now, when the user completes his business, he presses upon the flush lever 18 to activate flushing of the toilet 12. As the flushing water **16*a* begins to flush the toilet, water from the water supply pipe 32 enters the tank 16, causing a drop in water pressure in the flexible supply line 40. As a result of the pressure drop in the flexible supply line 40, the resilient bladder 66 deformably contracts as the piston head 68 presses thereagainst due to the biasing force of the spring 74. Accordingly, the piston head 68 ascends toward the cylinder head 64, carrying the piston head shaft 52 with it. As the piston head shaft 52 moves, the push rod 70 is similarly caused to move. The movement of the push rod 70 results in the thrust surface 96 thereof to forceably abut the locking lever 98, thereby causing the locking lever to assume the unlocked position B. As the locking lever moves, frictional binding between the shaft aperture 100 and the piston shaft 48 commences to cease. As the frictional binding ceases, the piston shaft is able to slide under urging of the seat biasing spring 94, thereby resulting in the seat undergoing a pivotal movement toward the bowl 14. The seat bias spring 94 is sufficiently compressed by selection of the neutral resting position P of the thrust washer 92 so as to supply force to cause the seat to pivot past the apex position, with gravity serving to continue pivoting movement of the seat until it is closed, as shown in FIG. 3. In this regard, as the seat pivots, eventually the thrust washer 92 will no longer be biasably compressed against the top end cap 46***b*, whereupon the seat biasing spring 94 will no longer be urging the seat to pivot toward the bowl, gravity supplying pivoting urge thereafter.

As the locking lever assumes the unlocked position, the biasing force of the seat biasing spring causes the fluid pressure between the diaphragm piston and the bottom end cap 46*c* to be greater than the fluid pressure between the diaphragm piston and the top end cap 46*b*. As a result of this pressure differential, the diaphragm piston is caused to resiliently deform as much as is allowed by its abutment with the rigid disc, as shown in FIG. 9, wherein the periphery 78*a* of the diaphragm piston 78 separates from the inside wall 46*a* of the cylinder 46. Accordingly, as the first piston rod 48 slides with respect to the cylinder 46, fluid F is able to flow at a flow rate having a selected amount of impediment defined by the separation between the periphery 78*a* and the inside wall 46*a*. The rate at which the seat 20 pivotably descends toward the bowl 14 is predetermined by selecting the stiffness of the diaphragm piston, the relative area between the rigid disc 82 and the diaphragm piston, and/or the viscosity of the fluid F.

The rate at which the seat pivotably descends is selected so that the seat will descend at a safe speed (for nearby children and pets) and softly impact upon the bowl. Further, pivoting of the seat 20 from the up position shown in FIG. 2 to the down position shown in FIG. 3 occurs before the reservoir of flushing water 16*a* in the tank has been replenished (or, in the case of non-tank-type toilets, the flushing cycle has ceased). Accordingly, the locking lever 98 is at all times in the unlocked position B since the resilient bladder 66 will be deformed thereduring. However, once the reservoir of flushing water is fully replenished (or, in the case of non-tank-type toilets, the flushing cycle ceases), and the plumbing within the toilet 12 begins to shut off flow of water into the tank, the resilient bladder will again deformably expand under increased water pressure in the flexible supply line 40. Thereupon, the resilient bladder will expand sufficiently to cause the piston head shaft 52 to move the thrust surface 96 of the push rod 70 so as to permit the locking lever to re-assume the locked position A.

While automatic lowering of the seat 20 has been described, if anyone wishes to lower the seat 20 at any time manually, all he or she need do is lift the locking lever 98 manually into the unlocked position B.

From the foregoing description, it is clear that the automatic toilet seat lowering mechanism 10 has the advantage of being synergistically operative with respect to a toilet with minimal installation difficulty.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An automatic seat lowering mechanism for a toilet, wherein the toilet includes a bowl, a flush lever connected with internal plumbing of the toilet for actuating flushing of the toilet wherein flushing water flushingly enters into the bowl and then subsequently into a drain, a seat pivotally connected with the bowl wherein the seat is pivotable from an up position whereat the seat is positioned substantially perpendicular with respect to the bowl to a down position whereat the seat is positioned coveringly over the bowl, and a connection adapted to be operatively connected with the toilet for receiving flushing water from a water supply pipe external to the toilet, said automatic seat lowering mechanism comprising:

water pressure sensor means for sealably connecting with the water supply pipe and for sensing a pressure drop in the water supply pipe as a consequence of the flush lever of the toilet being actuated to cause flushing of the toilet;

seat closure unit means for pivotably connecting with the bowl of the toilet, for pivotably connecting with the seat of the toilet, and for effecting pivoting of the seat from the up position to the down position, said seat closure unit means being hydraulically isolated from said water pressure sensor means and the water supply pipe; and mechanical linkage means connected with said water pressure sensor means and with said seat closure unit means for actuating said seat closure unit means to effect said pivoting of the seat in response to said water pressure sensor means sensing said pressure drop.

2. The automatic seat lowering mechanism of claim 1, wherein said water pressure sensor means comprises:

fitting means for sealably connecting with the water supply pipe;

a housing having a port;

a resilient bladder sealably connected with said port;

a flexible supply line connected with said fitting means and said port;

piston head means located in said housing for abutting said resilient bladder;

biasing means for biasing said piston head abuttably against said resilient bladder;

a piston head shaft connected with said piston head means; and means for guiding reciprocal movement of said piston head means and said piston head shaft in response to deformation of said resilient bladder due to changes in water pressure in said flexible supply line.

3. The automatic seat lowering mechanism of claim 2, wherein said seat closure unit means comprises:

a cylinder having an inner wall, a top end and a bottom end, said cylinder having a top end cap sealably connected with said top end, said cylinder having a bottom end cap sealably connected with said bottom end, said cylinder having contained therein a fluid, said bottom end cap being pivotally connected to the bowl of the toilet;

piston means within said cylinder for providing selective sealing with respect to said inner wall; and a piston shaft having a proximate end and an opposite distal end, said proximate end being connected with said piston means, said distal end being pivotally connected with the seat of the toilet; said top end cap being provided with an aperture through which said piston shaft extends and is sealably reciprocable;

wherein said piston means provides a first predetermined flow of said fluid past said piston means when the seat is pivoted from the up position to the down position, further wherein said piston means provides a second predetermined flow rate of said fluid past said piston means when the seat is pivoted from the down position to the up position.

4. The automatic seat lowering mechanism of claim 3, wherein said piston means comprises:

a diaphragm piston constructed of a flexible material, said diaphragm piston having a periphery for being selectively sealable with respect to said inner wall, said diaphragm piston having at least one flap defined by at least one cut through said flexible material for providing selective sealing of said diaphragm piston, said at least one cut being oriented diagonally with respect to a plane defined by said diaphragm piston; and a rigid disc having a predetermined cross-section, said rigid disc being connected with said piston shaft, said rigid disc being located abutting said diaphragm piston in axial alignment with respect thereto at a side thereof which faces toward said top end cap;

wherein said at least one flap flexes so that said at least one cut provides at least one opening in said flexible material to thereby provide said first predetermined flow rate of said fluid; further wherein said flexible material flexes in abutting cooperation with said rigid disc so that said periphery separates from said inner wall to thereby provide said second predetermined flow rate of said fluid.

5. The automatic seat lowering mechanism of claim 4, wherein said at least one flap comprises two flaps, each flap being oppositely disposed relative to said piston shaft; further wherein said at least one cut of each said flap comprises two cuts forming a substantially "L" shape comprising a radial cut extending from said periphery to a predetermined location and a transverse cut connecting with said radial cut at said predetermined location, wherein said flexing of each said flap occurs, respectively, along a radially disposed flex line extending from said transverse cut to said periphery.

6. The automatic seat lowering mechanism of claim 5, wherein the seat of the toilet pivots through an apex position wherein the seat is substantially perpendicular with respect to the bowl of the toilet; wherein said seat closure unit means further comprises:

thrust washer means for selectively abutting said top end cap; and biasing means for biasing said thrust washer means against said top end cap when said thrust washer means abuts said top end cap;

wherein said biasing of said thrust washer means against said top end cap is predetermined to effect pivotal movement of the seat from the up position to a second position between the apex position and the closed position.

7. The automatic seat lowering mechanism of claim 6, wherein said mechanical linkage means comprises:

a push rod connected with said piston head shaft, said push rod terminating in a thrust surface; and lock lever means adjacent said top end cap for providing selective locking of reciprocable movement of said piston shaft with respect to said cylinder in response to being abutted by said thrust surface.

8. The automatic seat lowering mechanism of claim 7, wherein said lock lever means is a lock lever movable between a locked position and an unlocked position, said lock lever having a bent end portion and a piston shaft aperture through which said piston shaft extends; wherein when said lock lever is in said locked position whereat said bent end forceably abuts said top end cap, said shaft aperture frictionally hinds with respect to said piston shaft to thereby lock said piston shaft with respect to said cylinder; further wherein when said lock lever is in said unlocked position said shaft aperture provides free slidable movement of said piston shaft therethrough; wherein said thrust surface causes said lock lever to assume said unlocked position when said resilient bladder in said water pressure sensor means is collapsibly deformed in response to said water pressure drop.

9. The automatic seat lowering mechanism of claim 8, wherein said lock lever means further comprises manual release means for a user to manually move said locking lever from said locked position to said unlocked position.

10. The automatic seat lowering mechanism of claim 9, wherein a flange is adapted to be located on each side of the bowl, each flange being fastened to a floor by at least one threaded fastener; wherein said bottom end cap is pivotally connected to a threaded fastener of one of the flanges.

11. The automatic seat lowering mechanism of claim 1, wherein said seat closure unit means comprises hydraulic means for controlling pivoting of the seat.

12. A toilet equipped with an automatic seat lowering mechanism, wherein the toilet is adapted to rest upon a floor and is adapted to be connected to an external water supply pipe and a drain, said toilet comprising:

a bowl;

internal plumbing means for flushing of the toilet by flushing water flushingly entering into said bowl and then subsequently into the drain;

a flush lever for actuating said flushing;

a seat pivotally connected with said bowl, said seat being pivotable from an up position whereat said seat is positioned substantially perpendicular with respect to said bowl to a down position whereat said seat is positioned coveringly over said bowl;

a flange located, respectively, on each side of said bowl for being fastened to the floor;

a connection operatively connected to the toilet for receiving flushing water from the water supply pipe; and an automatic seat lowering mechanism comprising:

water pressure sensor means connected with the water supply pipe for sensing a pressure drop in the water supply pipe as a consequence of said flush lever being actuated to cause said flushing;

seat closure unit means pivotably connected with said bowl and pivotably connected with said seat for effecting pivoting of said seat from the up position to the down position, said seat closure unit means being, hydraulically isolated from the water pressure sensor means and said water supply pipe; and mechanical linkage means connected with said water pressure sensor means and with said seat closure unit means for actuating said seat closure unit means to effect said pivoting of said seat in response to said water pressure sensor means sensing said pressure drop.

13. The toilet of claim 12, wherein said water pressure sensor means comprises:

fitting means for sealably connecting with the water supply pipe;

a housing having a port;

a resilient bladder sealably connected with said port;

a flexible supply line connected with said fitting means and said port;

piston head means located in said housing for abutting said resilient bladder;

biasing means for biasing said piston head abuttably against said resilient bladder;

a piston head shaft connected with said piston head means; and means for guiding reciprocal movement of said piston head means and said piston head shaft in response to deformation of said resilient bladder due to changes in water pressure in said flexible supply line.

14. The toilet of claim 13, wherein said seat closure unit means comprises:

a cylinder having an inner wall, a top end and a bottom end, said cylinder having a top end cap sealably connected with said top end, said cylinder having a bottom end cap sealably connected with said bottom end, said cylinder having contained therein a fluid, said bottom end cap being pivotally connected to the bowl of the toilet;

piston means within said cylinder for providing selective sealing with respect to said inner wall; and a piston shaft having a proximate end and an opposite distal end, said proximate end being connected with said piston means, said distal end being pivotally connected with said seat; said top end cap being provided with an aperture through which said piston shaft extends and is sealably reciprocable;

wherein said piston means provides a first predetermined flow of said fluid past said piston means when said seat is pivoted from said up position to said down position, further wherein said piston means provides a second predetermined flow rate of said fluid past said piston means when said seat is pivoted from said down position to said up position.

15. The toilet of claim 14, wherein said piston means comprises:

a diaphragm piston constructed of a flexible material, said diaphragm piston having a periphery for being selectively sealable with respect to said inner wall, said diaphragm piston having at least one flap defined by at least one cut through said flexible material for providing selective sealing of said diaphragm piston, said at least one cut being oriented diagonally with respect to a plane defined by said diaphragm piston; and a rigid disc having a predetermined cross-section, said rigid disc being connected with said piston shaft, said rigid disc being located abutting said diaphragm piston in axial alignment with respect thereto at a side thereof which faces toward said top end cap;

where said at least one flap flexes so that said at least one cut provides at least one opening in said flexible material to thereby provide said first predetermined flow rate of said fluid; further wherein said flexible material flexes in abutting cooperation with said rigid disc so that said periphery separates from said inner wall to thereby provide said second predetermined flow rate of said fluid.

16. The toilet of claim 15, wherein said at least one flap comprises two flaps, each flap being oppositely disposed relative to said piston shaft; further wherein said at least one cut of each said flap comprises two cuts forming a substantially "L" shape comprising a radial cut extending from said periphery to a predetermined location and a transverse cut connecting with said radial cut at said predetermined location, wherein said flexing of each said flap occurs, respectively, along a radially disposed flex line extending from said transverse cut to said periphery.

17. The toilet of claim 16, wherein the seat of the toilet pivots through an apex position wherein said seat is substantially perpendicular with respect to said bowl wherein said seat closure unit means further comprises:

thrust washer means for selectively abutting said top end cap; and biasing means for biasing said thrust washer means against said top end cap when said thrust washer means abuts said top end cap;

wherein said biasing of said thrust washer means against said top end cap is predetermined to effect pivotal movement of said seat from said up position to a second position between said apex position and said closed position.

18. The toilet of claim 17, wherein said mechanical linkage means comprises:

a push rod connected with said piston head shaft, said push rod terminating in a thrust surface; and lock lever means adjacent said top end cap for providing selective locking of reciprocable movement of said piston shaft with respect to said cylinder in response to being abutted by said thrust surface.

19. The toilet of claim 18, wherein said lock lever means is a lock lever movable between a locked position and an unlocked position, said lock lever having a bent end portion and a piston shaft aperture through which said piston shaft extends; wherein when said lock lever is in said locked position whereat said bent end forceably abuts said top end cap, said shaft aperture frictionally binds with respect to said piston shaft to thereby lock said piston shaft with respect to said cylinder; further wherein when said lock lever is in said unlocked position said shaft aperture provides free slidable movement of said piston shaft therethrough; wherein said thrust surface causes said lock lever to assume said unlocked position when said resilient bladder in said water pressure sensor means is collapsibly deformed in response to said water pressure drop.

20. The toilet of claim 19, wherein said lock lever means further comprises manual release means for a user to manually move said locking lever from said locked position to said unlocked position.

21. The toilet of claim 20, wherein each said flange is fastened to the floor by at least one threaded fastener; wherein said bottom end cap is pivotally connected to a threaded fastener of one of the flanges.

22. The toilet of claim 12, wherein said seat closure unit means comprises hydraulic means for controlling pivoting of the seat.

* * * * *